US011095041B2

(12) United States Patent
Cao et al.

(10) Patent No.: US 11,095,041 B2
(45) Date of Patent: Aug. 17, 2021

(54) COLLINEAR ANTENNA ASSEMBLY AND SERIES-FED OMNIDIRECTIONAL COLLINEAR ANTENNA ARRAY

(71) Applicant: Norsat International Inc., Richmond (CA)

(72) Inventors: Yazi Cao, Shenzhen (CN); Steve Hunt, Shenzhen (CN); Tong Li, Shenzhen (CN)

(73) Assignee: NORSAT INTERNATIONAL INC., Richmond (CA)

( * ) Notice: Subject to any disclaimer, the term of this patent is extended or adjusted under 35 U.S.C. 154(b) by 13 days.

(21) Appl. No.: 16/289,164

(22) Filed: Feb. 28, 2019

(65) Prior Publication Data

US 2019/0267720 A1 Aug. 29, 2019

(30) Foreign Application Priority Data

Feb. 28, 2018 (CN) ..... 201810169086.9

(51) Int. Cl.
*H01Q 21/12* (2006.01)
*H01Q 21/06* (2006.01)
(Continued)

(52) U.S. Cl.
CPC ..... *H01Q 21/12* (2013.01); *H01Q 1/38* (2013.01); *H01Q 9/30* (2013.01); *H01Q 21/062* (2013.01); *H01Q 21/10* (2013.01)

(58) Field of Classification Search
None
See application file for complete search history.

(56) References Cited

U.S. PATENT DOCUMENTS 4,857,939 A 8/1989 Shimazaki
5,568,161 A 10/1996 Fulmer
(Continued)

FOREIGN PATENT DOCUMENTS

CN 104078770 A 10/2014
EP 1411588 A1 4/2004
(Continued)

OTHER PUBLICATIONS

O. Niksan, M. Bemani and A. Farzamnia, "A Compact Multi-band mm-Wave Franklin Array With Frequency Scanning Capability," 2019 Sixth Iranian Conference on Radar and Surveillance Systems, Isfahan, Iran, 2019, pp. 1-6, doi: 10.1109/ICRSS48293.2019.9026556. (Year: 2019).*

(Continued)

*Primary Examiner* — Lynda Jasmin
*Assistant Examiner* — Laura Yesildag
(74) *Attorney, Agent, or Firm* — Calfee, Halter & Griswold LLP

(57) ABSTRACT

A collinear antenna assembly and a series-fed omnidirectional collinear antenna array are provided. The collinear antenna assembly includes a plurality of phase delayers connected in series, and an end portion of each phase delayer is connected to an antenna radiating unit; the phase delayer includes a circuit wire printed on a dielectric plate, two ends of the circuit wire are connected to the antenna radiating unit, a wire length, a wire width and a wire spacing of the circuit wire are set based on preset wiring rules, the wire lengths, the wire widths and the wire spacing of the circuit wires of the phase delayers set based on different preset wiring rules are different, so that a phase and an amplitude fed to each antenna radiating unit are accurately controlled.

18 Claims, 6 Drawing Sheets

(51) Int. Cl.

| | |
|---|---|
| ***H01Q 21/10*** | (2006.01) |
| ***H01Q 1/38*** | (2006.01) |
| ***H01Q 9/30*** | (2006.01) |

(56) References Cited

U.S. PATENT DOCUMENTS

| | | | | |
|---|---|---|---|---|
| 7,170,463 | B1 | 1/2007 | Seavey | |
| 2012/0119968 | A1* | 5/2012 | Fong | H01Q 9/42 343/825 |
| 2015/0270605 | A1* | 9/2015 | Nilsson | H01Q 21/08 343/795 |
| 2017/0016990 | A1* | 1/2017 | Yaacobi | G02F 1/292 |
| 2017/0264019 | A1* | 9/2017 | Mu | H01Q 5/378 |
| 2019/0097321 | A1* | 3/2019 | Lee | H01Q 1/50 |
| 2019/0393917 | A1* | 12/2019 | Price | H01Q 1/38 |

FOREIGN PATENT DOCUMENTS

| | | | | |
|---|---|---|---|---|
| JP | S62233903 | A | 10/1987 | |
| WO | 2017021711 | A1 | 2/2017 | |
| WO | WO-2018065404 | A1 * | 4/2018 | H01Q 1/44 |

OTHER PUBLICATIONS

S. Chen, I. Lan and P. Hsu, "In-Line Series-Feed Collinear Slot Array Fed by a Coplanar Waveguide," in IEEE Transactions on Antennas and Propagation, vol. 55, No. 6, pp. 1739-1744, Jun. 2007, doi: 10.1109/TAP.2007.898620 (Year: 2007).*

Search Report from European Patent Application No. 19159918.2 dated Jul. 17, 2019.

Official Communication of EP120922AN dated Dec. 8, 2020 (7 pages).

* cited by examiner

A radiation gain direction diagram of a series-fed omnidirectional collinear antenna array provided by the present invention

******** A radiation gain direction diagram obtained by an omnidirectional collinear antenna array of the conventional art

COLLINEAR ANTENNA ASSEMBLY AND SERIES-FED OMNIDIRECTIONAL COLLINEAR ANTENNA ARRAY

CROSS-REFERENCE TO RELATED APPLICATIONS

This application claims priority to Chinese Patent Application No. 201810169086.9, filed Feb. 28, 2018, the entire content of which is incorporated herein by reference.

TECHNICAL FIELD

The present invention relates to the field of high-frequency antenna array technologies, and more specifically, to a collinear antenna assembly and a series-fed omnidirectional collinear antenna array.

BACKGROUND

With the rapid growth of wireless communication system, the demand for a high-performance horizontal omnidirectional radiation pattern collinear antenna is increased. Since the structure is relatively simple and the production cost is low, a series-fed omnidirectional collinear antenna array is widely used in modern wireless communication system.

The omnidirectional collinear antenna array is typically implemented through coaxial line segment translocation interconnection. These arrays take effect through directing energy into a non-radiating section of a coaxial line in a half cycle, and an exposed section radiates in a positive half cycle, thus ensuring that the collinear antenna only radiates in the positive half cycle, and resulting in a single main lobe and multiple side lobes. An input impedance of the array design increases with the increase of units, thus resulting in narrow bandwidth and long size.

The most common series-fed omnidirectional collinear antenna array is a circular gap-fed coaxial dipole array, which is also known as COCO (Coaxial collinear), consisting of multiple welded dipole assemblies piled. A coaxial line stripped of a shielding layer is inserted to form a circular gap array between dipole separators of each assembly, the dipole separator is used for feeding back adjacent coaxial dipoles, and a choke line of ¼ wavelength integrated in a dipole sleeve isolates a field strength of each unit. Since a unit diameter is much larger than the coaxial line, the design can provide a wider operating bandwidth, but it is achieved at the expense of a complicated structure.

Therefore, the common collinear antenna array is complex in structure, narrow in bandwidth, long in length, unstable in antenna gain and radiation pattern, prone to mechanical stability and manufacturability problem, and unable to adapt to different application scenarios.

SUMMARY

In view of this, the embodiments of the present invention provide a collinear antenna assembly and a series-fed omnidirectional collinear antenna array, which can adapt to different application scenarios.

In order to achieve the objects above, the embodiments of the present invention provide the following technical solutions:

A collinear antenna assembly includes:

a plurality of phase delayers connected in series, wherein an end portion of each phase delayer is connected to an antenna radiating unit; and the phase delayer includes a circuit wire printed on a dielectric plate, an end portion of the circuit wire is connected to the antenna radiating unit, a wire length, a wire width and a wire spacing of the circuit wire are set based on preset wiring rules, and at least one of the wire lengths, the wire width and the wire spacing of the circuit wire set based on different preset wiring rules are different.

A series-fed omnidirectional collinear antenna array includes:

a feed-through connector, a supporting tube, an impedance matching assembly and a collinear antenna assembly connected in series;

wherein an antenna radiating unit at an end portion of the collinear antenna assembly is connected to the impedance matching assembly; and the collinear antenna assembly refers to the collinear antenna assembly above.

Based on the technical solutions above, the embodiments of the present invention disclose the collinear antenna assembly and the series-fed omnidirectional collinear antenna array, wherein the collinear antenna assembly includes the plurality of phase delayers connected in series, and two ends of each phase delayer are welded with the antenna radiating unit; the phase delayer includes the circuit wire printed on the dielectric plate, the wire length, the wire width and the wire spacing of the circuit wire are set based on preset wiring rules, and the wire lengths, the wire widths and the wire spacing of the circuit wire of the phase delayer set based on different preset wiring rules are different. The wire length, the wire width and the wire spacing of the circuit wire of the phase delayer are set based on different preset wiring rules, so that the phase and the amplitude fed to each antenna radiating unit are accurately controlled, thus effectively controlling a maximum radiation efficiency of each antenna radiating unit, and improving a gain and a total radiation efficiency of the antenna array, so as to adapt to different application scenarios.

BRIEF DESCRIPTION OF THE DRAWINGS

In order to more clearly illustrate the technical solutions in the embodiments of the present invention or the prior art, the drawings to be used in the embodiments or the description of the prior art will be briefly introduced below. Obviously, the drawings in the following description are merely the embodiments of the present invention, and those skilled in the art can further obtain other drawings according to the following drawings provided by the embodiments of the present invention without going through any creative work.

DETAILED DESCRIPTION

The technical solutions in the embodiments of the present invention are clearly and completely described below with reference to the drawings in the embodiments of the present invention, and obviously, the described embodiments are merely a part of embodiments of the present invention instead of all embodiments. Based on the embodiments in the present invention, all other embodiments obtained by those skilled in the art on the premise of not going through creative works belong to the protection scope of the present invention.

Figure 1:
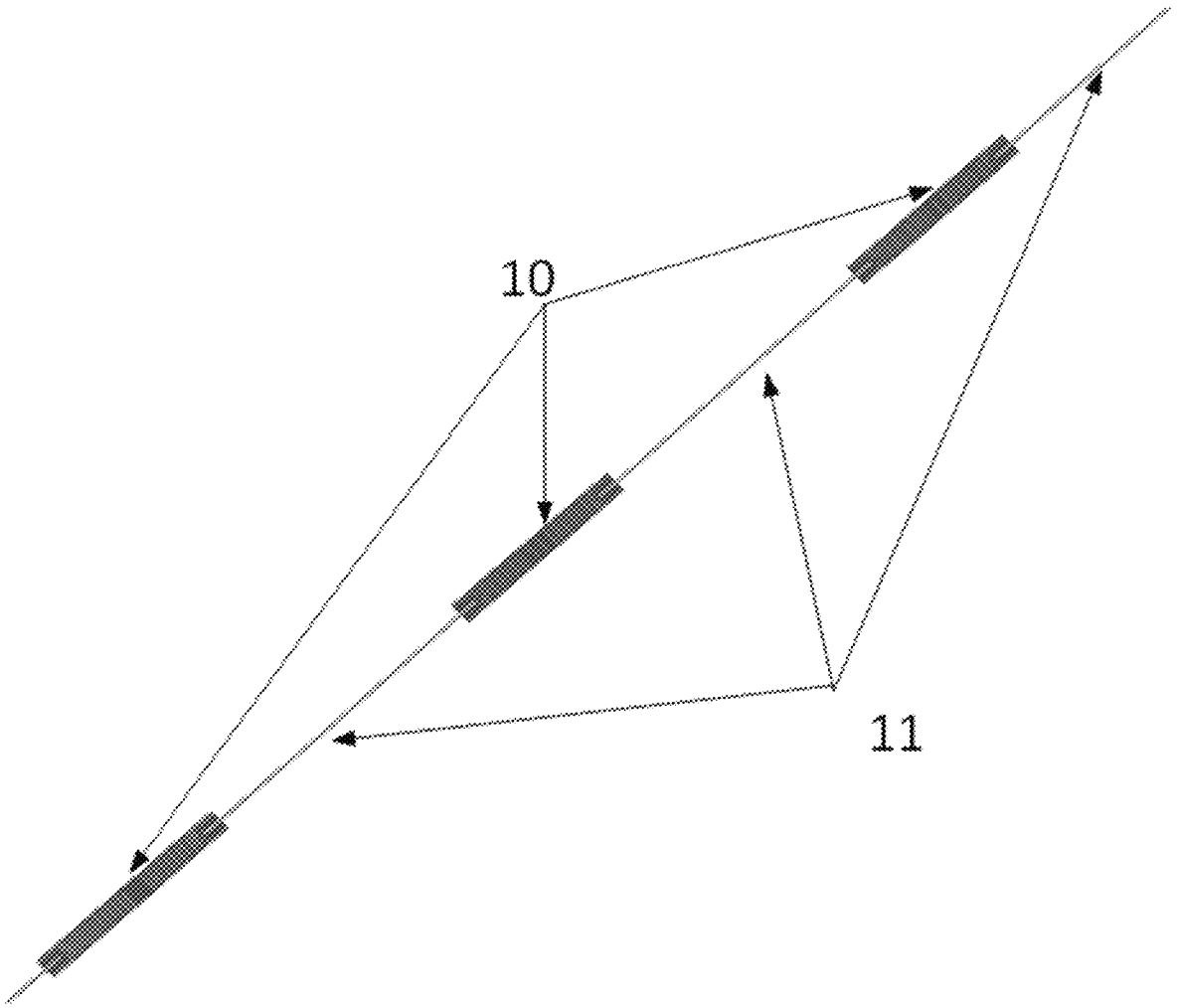
FIG. 1 is a structure diagram of a collinear antenna assembly provided by embodiments of the present invention.

With reference to FIG. 1, FIG. 1 is a structure diagram of a collinear antenna assembly provided by the embodiments of the present invention, the collinear antenna assembly specifically includes a plurality of (three phase delayers are shown in the figure, and any number of the phase delayers may be available in an actual application process) phase delayers 10 connected in series, wherein an end portion of each phase delayer 10 is connected to an antenna radiating unit 11, an end portion of the collinear antenna assembly is the antenna radiating unit 11, a plurality of phase delayers 10 connected in series are included between the antenna radiating units 11 at two end portions, for one of the phase delayers 10, the phase delayer 10 is connected in series with other phase delayers 10 through the antenna radiating unit 11, and in the embodiment, the antenna radiating unit 11 is exemplarily welded to the end portion of the phase delayer 10, and the antenna radiating unit 11 may also be connected to the end portion of the phase delayer 10 in other ways, such as riveting, casting, bolting, etc. The phase delayer 10 includes a circuit wire printed on a dielectric plate, two ends of the circuit wire are connected to the antenna radiating unit, a wire length, a wire width and a wire spacing of the circuit wire are set based on preset wiring rules, and the wire length, the wire width and/or the wire spacing of the circuit wire set based on different preset wiring rules are different, thus accurately controlling the phase and amplitude fed to each antenna radiating element can be led, so that a phase and an amplitude fed to each antenna radiating unit are accurately controlled, thus effectively controlling a maximum radiation efficiency of each antenna radiating unit, and improving a gain and a total radiation efficiency of an antenna array, so as to adapt to different application scenarios. Therefore. the preset wiring rule of the circuit wire applied to corresponding phase delayer may be determined according to the phase and the amplitude expected to be fed to the specific antenna radiating unit, thus determining the wire length, the wire width and the wire spacing of the circuit wire of corresponding phase delayer.

Figure 2A:
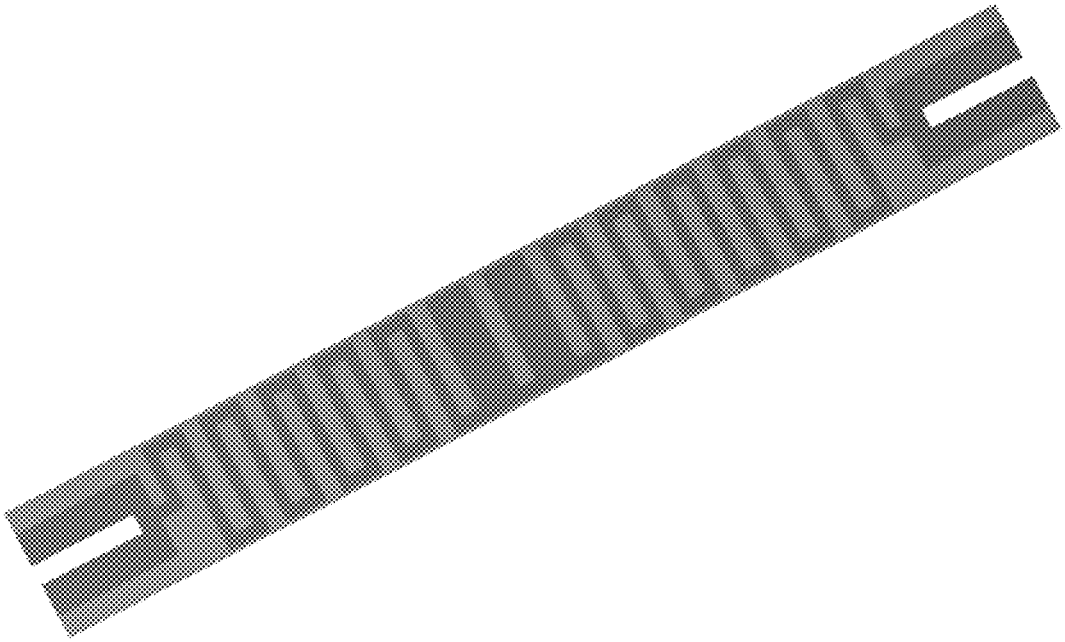
FIG. 2A, FIG. 2B and FIG. 2C are diagrams of phase delayers containing different wire lengths, wire widths and wire spacing.
Figure 2B:
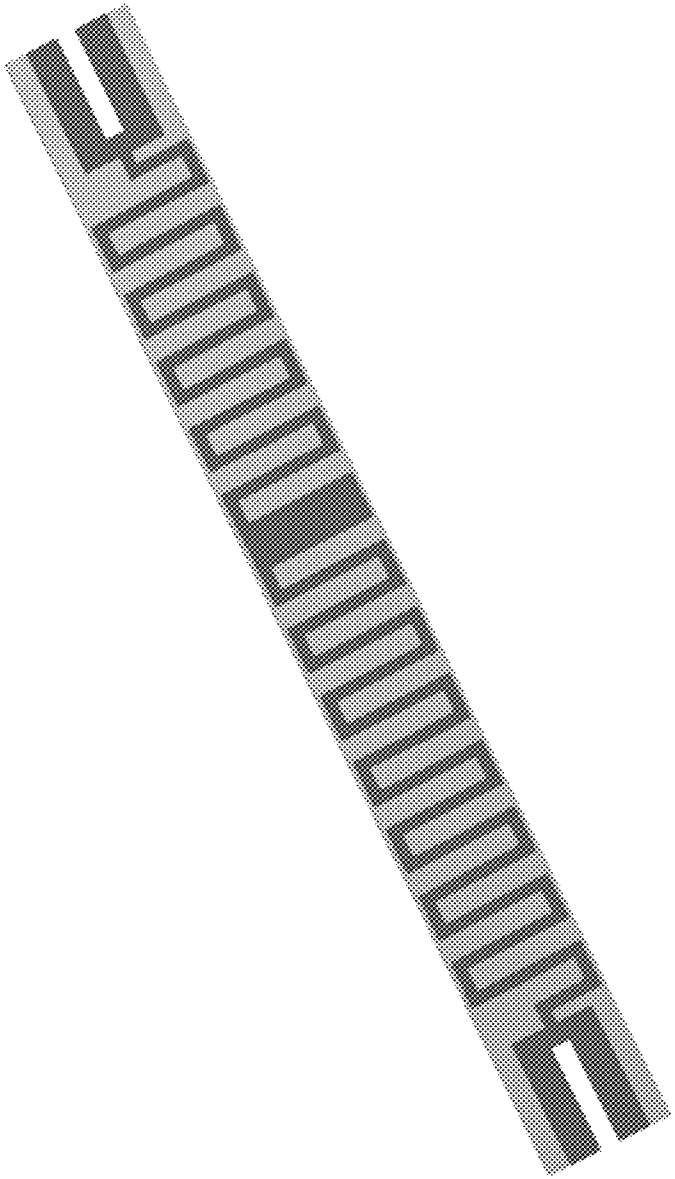
Figure 2C:
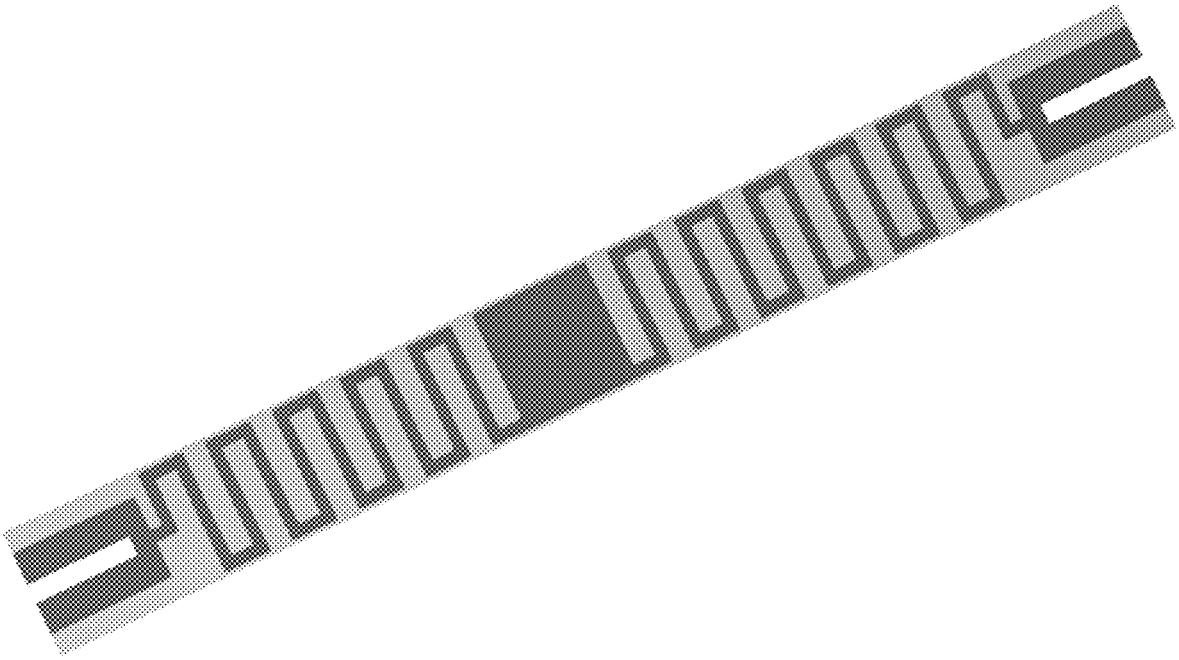

FIG. 2A, FIG. 2B and FIG. 2C are diagrams of the phase delayers containing different wire lengths, wire widths and wire spacing due to application of different preset wiring rules.

It needs to be noted that the circuit wire on the phase delayer 10 is an arcuate wiring or a curved wiring, so as to shorten a physical length of the antenna. An appearance shape of the phase delayer is a rectangle, a circle, an ellipse or a polygon. The antenna radiating unit is a copper antenna radiating unit or other metal antenna radiating units. The antenna radiating unit is printed on the dielectric plate. The dielectric plate includes a dielectric substrate or a metal stamping plate. The dielectric substrate includes a single-layer PCB (printed circuit board) or a multi-layer PCB, and a simple structure of the PCB board has low production cost and is convenient for mass production and assembly.

The embodiment discloses a collinear antenna assembly, which includes a plurality of phase delayers connected in series, wherein an end portion of each phase delayer is connected to an antenna radiating unit; and the phase delayer includes a circuit wire printed on a dielectric plate, an end portion of the circuit wire is connected to the antenna radiating unit, a wire length, a wire width and a wire spacing of the circuit wire are set based on preset wiring rules, and the wire lengths, the wire widths and the wire spacing of the circuit wire set based on different preset wiring rules are different. The wire length, the wire width and the wire spacing of the circuit wire of the phase delayer are set based on different preset wiring rules, so that a phase and an amplitude fed to each antenna radiating unit are accurately controlled, thus effectively controlling a maximum radiation efficiency of each antenna radiating unit, and improving a gain and a total radiation efficiency of an antenna array, so as to adapt to different application scenarios.

Figure 3:
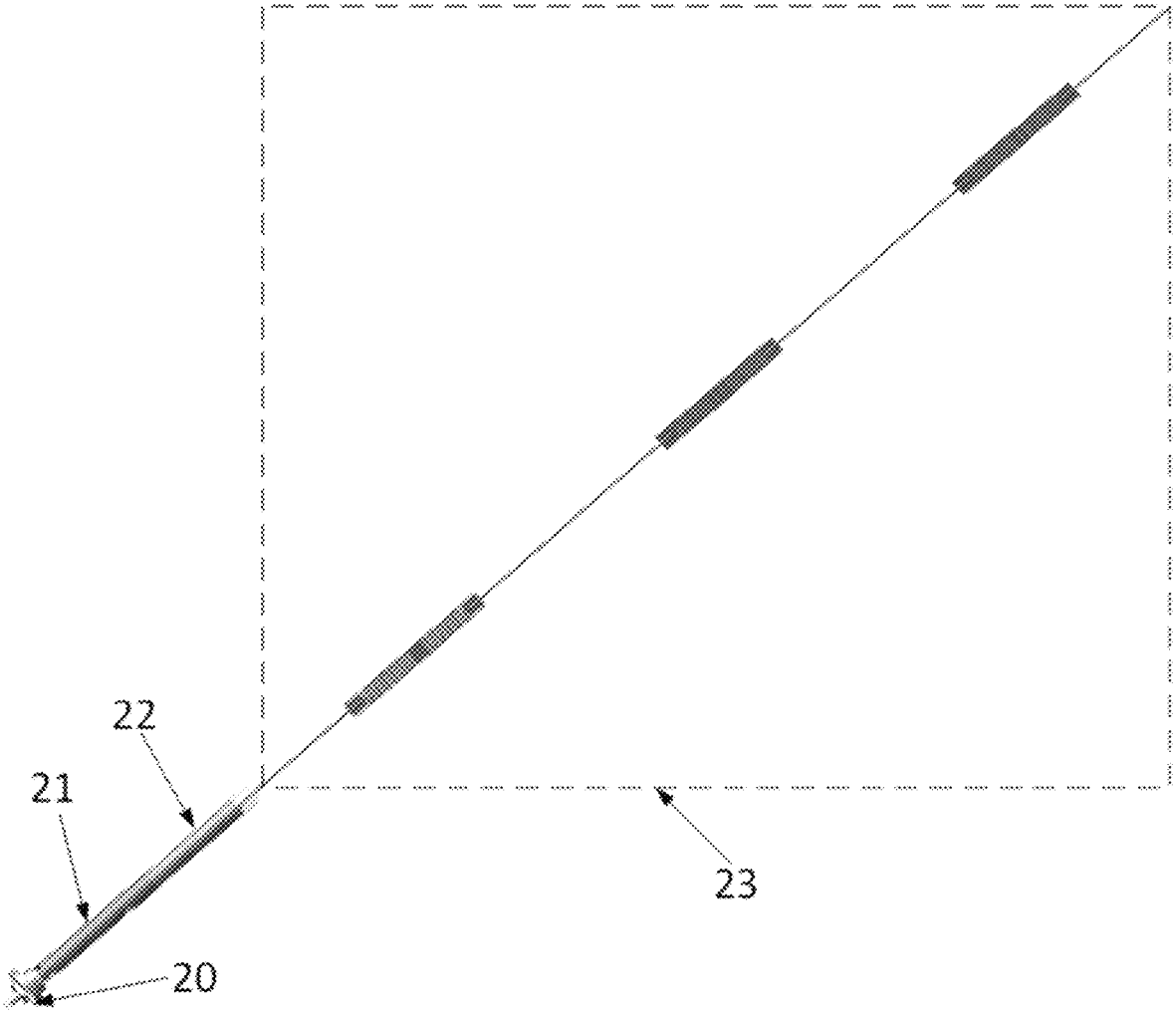
FIG. 3 is a structure diagram of a series-fed omnidirectional collinear antenna array provided by the embodiments of the present invention.

With reference to FIG. 3, FIG. 3 is a structure diagram of a series-fed omnidirectional collinear antenna array provided by the embodiments of the present invention, the series-fed omnidirectional collinear antenna array includes a feed-through connector 20, a supporting tube 21, an impedance matching assembly 22 and a collinear antenna assembly 23 sequentially connected; wherein an antenna radiating unit at an end portion of the collinear antenna assembly is connected to the impedance matching assembly; and a structure of the collinear antenna assembly may be described with reference to the embodiment above, which is not repeated in the embodiment.

It needs to be noted that the feed-through connector includes a feeder and a joint.

Figure 4:
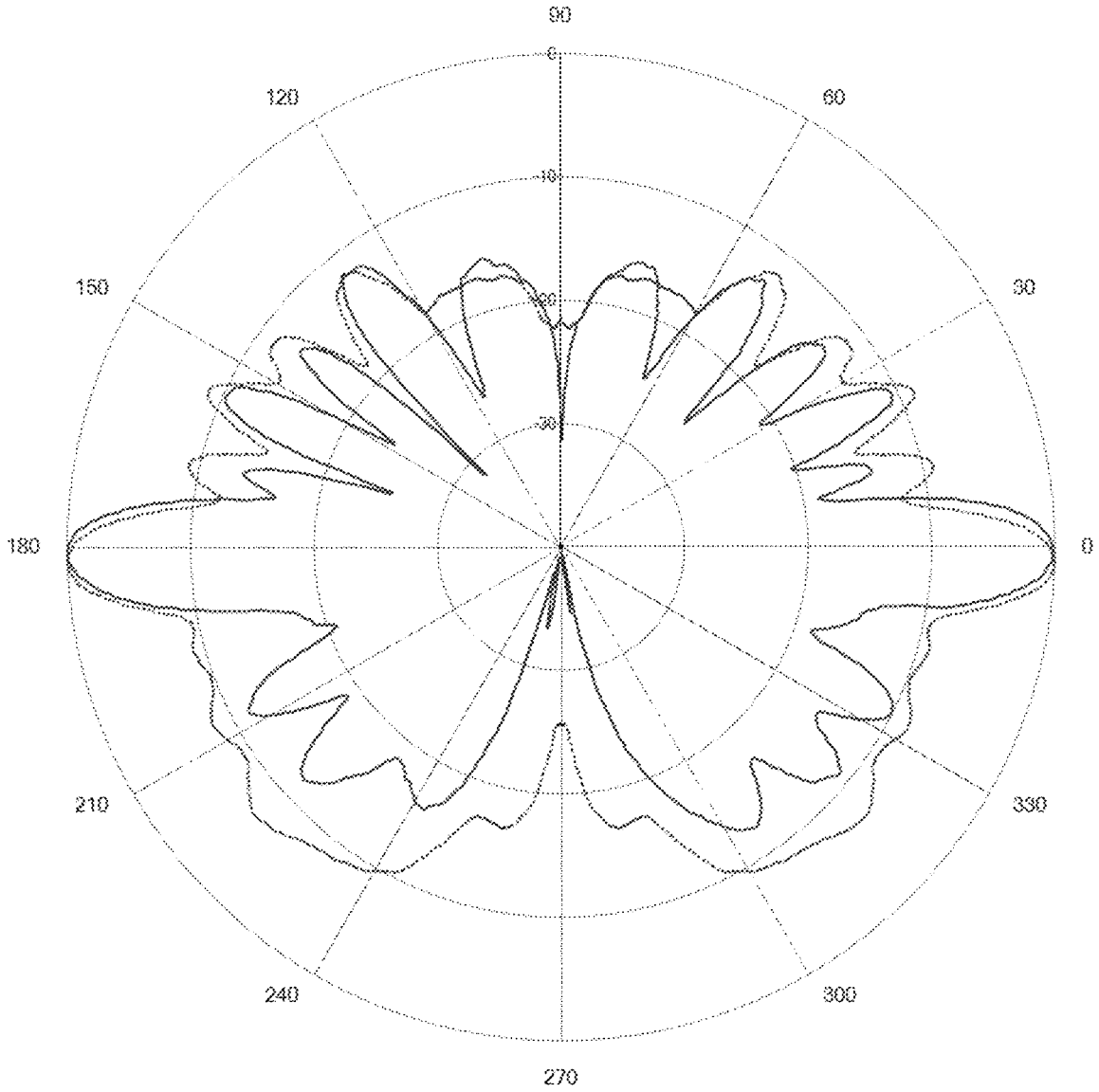
FIG. 4 illustrates a comparison between a radiation gain direction diagram of the series-fed omnidirectional collinear antenna array provided by the present invention and a radiation gain direction diagram obtained by the omnidirectional collinear antenna array based on the conventional art.

The embodiment discloses a series-fed omnidirectional collinear antenna array, which includes a feed-through connector, a supporting tube, an impedance matching assembly and a collinear antenna assembly connected in series; wherein an antenna radiating unit at an end portion of the collinear antenna assembly is connected to the impedance matching assembly; the collinear antenna assembly includes a plurality of phase delayers connected in series, wherein an end portion of each phase delayer is connected to an antenna radiating unit; and the phase delayer includes a circuit wire printed on a dielectric plate, an end portion of the circuit wire is connected to the antenna radiating unit, a wire length, a wire width and a wire spacing of the circuit wire are set based on preset wiring rules, and the wire lengths, the wire widths and the wire spacing of the circuit wire set based on different preset wiring rules are different. As shown in FIG. 4, it can be seen from the comparison with the radiation gain direction diagram obtained by the omnidirectional collinear antenna array based on the conventional art that, in the embodiment, the wire length, the wire width and the wire spacing of the circuit wire of the phase delayer are set based on different preset wiring rules, so that a phase and an amplitude fed to each antenna radiating unit are accurately controlled, thus effectively controlling a maximum radiation efficiency of each antenna radiating unit, and improving a gain and a total radiation efficiency of an antenna array. Meanwhile, a test result obtained in the embodiment shows that the art may obviously reduce a sidelobe amplitude of the antenna array, and meanwhile, a stable radiation downtilt is obtained, so as to adapt to different application scenarios.

In conclusion:

The embodiments of the present invention disclose a collinear antenna assembly and a series-fed omnidirectional collinear antenna array, wherein the collinear antenna assembly includes a plurality of phase delayers connected in series, and an end portion of each phase delayer is connected to an antenna radiating unit; the phase delayer includes a circuit wire printed on a dielectric plate, two ends of the circuit wire are connected to the antenna radiating unit, a wire length, a wire width and a wire spacing of the circuit wire are set based on preset wiring rules, the wire lengths, the wire widths and the wire spacing of the circuit wire of the phase delayer set based on different preset wiring rules are different. The wire length, the wire width and the wire spacing of the circuit wire of the phase delayer are set based on different preset wiring rules, so that a phase and an amplitude fed to each antenna radiating unit are accurately controlled, thus effectively controlling a maximum radiation efficiency of each antenna radiating unit, and improving a gain and a total radiation efficiency of an antenna array, so as to adapt to different application scenarios.

The various embodiments in the description are described in a progressive manner, each embodiment focuses on the differences from other embodiments, and the same and similar parts among the various embodiments can be seen from each other.

The foregoing description of the disclosed embodiments enables those skilled in the art to achieve or use the present invention. The various modifications to these embodiments will be apparent to those skilled in the art, and the general principles defined herein may be implemented in other embodiments without departing from the spirit or scope of the present invention. Therefore, the present invention will not be limited to these embodiments shown herein, and shall has a widest scope consistent with the principles and novel features disclosed herein.

We claim:

1. A series-fed omnidirectional single-band high gain collinear antenna array, comprising:

a feed-through connector, a supporting tube, an impedance matching assembly and a single-band collinear antenna assembly connected in series;

wherein an antenna radiating unit at an end portion of the collinear antenna assembly is connected to the impedance matching assembly; and the single-band collinear antenna assembly comprises:

a plurality of phase delayers connected in series and interspaced with a plurality of antenna radiating units, wherein an end portion of each phase delayer is connected to one or more antenna radiating units;

each phase delayer comprises a circuit wire printed on a dielectric plate, a first and second ends of the circuit wire are connected to the one or more antenna radiating units, wherein a wire length, a wire width and a wire spacing of the circuit wire of each phase delayer are determined based on preset wiring rules for achieving a high radiation gain of the single-band collinear antenna assembly, wherein a first preset wiring rule is applied to a first phase delayer, a second preset wiring rule is applied to a second phase delayer, and at least one of the wire lengths, the wire widths and the wire spacings of the circuit wire of the first phase delayer is different from at least one of the wire lengths, the wire widths and the wire spacings of the circuit wire of the second phase delayer, wherein the first preset wiring rule is different from the second preset wiring rule, wherein the preset wiring rules are determined according to a phase and an amplitude fed to each antenna radiating unit, wherein the feed-through connector comprises a feeder and a joint and a maximum radiation efficiency of each antenna radiating unit is controlled based on the determined preset wiring rules applied to each phase delayer.

2. The series-fed omnidirectional single-band high gain collinear antenna array according to claim 1, wherein the circuit wire on the phase delayer is an arcuate wiring or a curved wiring.

3. The series-fed omnidirectional single-band high gain collinear antenna array according to claim 2, wherein the dielectric plate comprises a dielectric substrate or a metal stamping plate.

4. The series-fed omnidirectional single-band high gain collinear antenna assembly array according to claim 3, wherein the dielectric substrate comprises a single-layer PCB printed circuit board or a multi-layer PCB printed circuit board.

5. The series-fed omnidirectional single-band high gain collinear antenna array according to claim 1, wherein an appearance shape of the phase delayer is a rectangle, a circle, an ellipse or a polygon.

6. The series-fed omnidirectional single-band high gain collinear antenna assembly array according to claim 5, wherein the dielectric plate comprises a dielectric substrate or a metal stamping plate.

7. The series-fed omnidirectional single-band high gain collinear antenna assembly array according to claim 6, wherein the dielectric substrate comprises a single-layer PCB printed circuit board or a multi-layer PCB printed circuit board.

8. The series-fed omnidirectional single-band high gain collinear antenna array according to claim 1, wherein the antenna radiating unit is a metal antenna radiating unit.

9. The series-fed omnidirectional single-band high gain collinear antenna array according to claim 8, wherein the metal antenna radiating unit is a copper antenna radiating unit.

10. The series-fed omnidirectional single-band high gain collinear antenna assembly array according to claim 9, wherein the dielectric plate comprises a dielectric substrate or a metal stamping plate.

11. The series-fed omnidirectional single-band high gain collinear antenna assembly array according to claim 10, wherein the dielectric substrate comprises a single-layer PCB printed circuit board or a multi-layer PCB printed circuit board.

12. The series-fed omnidirectional single-band high gain collinear antenna assembly array according to claim 8, wherein the dielectric plate comprises a dielectric substrate or a metal stamping plate.

13. The series-fed omnidirectional single-band high gain collinear antenna assembly array according to claim 12, wherein the dielectric substrate comprises a single-layer PCB printed circuit board or a multi-layer PCB printed circuit board.

14. The series-fed omnidirectional single-band high gain collinear antenna array according to claim 1, wherein the antenna radiating unit is printed on the dielectric plate.

15. The series-fed omnidirectional single-band high gain collinear antenna assembly array according to claim 14, wherein the dielectric plate comprises a dielectric substrate or a metal stamping plate.

16. The series-fed omnidirectional single-band high gain collinear antenna assembly array according to claim 15, wherein the dielectric substrate comprises a single-layer PCB printed circuit board or a multi-layer PCB printed circuit board.

17. The series-fed omnidirectional single-band high gain collinear antenna array according to claim 1, wherein the dielectric plate comprises a dielectric substrate or a metal stamping plate.

18. The series-fed omnidirectional single-band high gain collinear antenna array according to claim 17, wherein the dielectric substrate comprises a single-layer PCB printed circuit board or a multi-layer PCB printed circuit board.

* * * * *